US009460655B2

(12) United States Patent
Qing et al.

(10) Patent No.: US 9,460,655 B2
(45) Date of Patent: Oct. 4, 2016

(54) PIXEL CIRCUIT FOR AC DRIVING, DRIVING METHOD AND DISPLAY APPARATUS

(71) Applicants: BOE TECHNOLOGY GROUP CO., LTD., Beijing (CN); Chengdu BOE OPTOELECTRONICS TECHNOLOGY CO., LTD., Chengdu, Sichuan (CN)

(72) Inventors: Haigang Qing, Beijing (CN); Xiaojing Qi, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 57 days.

(21) Appl. No.: 14/416,206

(22) PCT Filed: Jun. 26, 2014

(86) PCT No.: PCT/CN2014/080897
§ 371 (c)(1),
(2) Date: Jan. 21, 2015

(87) PCT Pub. No.: WO2015/062296
PCT Pub. Date: May 7, 2015

(65) Prior Publication Data

US 2015/0325169 A1 Nov. 12, 2015

(30) Foreign Application Priority Data

Oct. 31, 2013 (CN) ..... 2013 1 0529546

(51) Int. Cl.
*G09G 3/30* (2006.01)
*G09G 3/32* (2016.01)

(52) U.S. Cl.
CPC .... *G09G 3/3225* (2013.01); *G09G 2300/0809* (2013.01); *G09G 2300/0866* (2013.01); *G09G 2320/0233* (2013.01); *G09G 2320/045* (2013.01)

(58) Field of Classification Search
CPC ..... G09G 3/30; G09G 3/32; G09G 3/3208; G09G 3/3216; G09G 3/3225; G09G 3/3233; G09G 3/3241; G09G 3/325; G09G 3/3258
USPC ..... 345/76–83; 315/169.3
See application file for complete search history.

(56) References Cited

U.S. PATENT DOCUMENTS

2005/0259142 A1* 11/2005 Kwak ..... G09G 3/3233 347/238
2006/0186822 A1* 8/2006 Park ..... G09G 3/3233 315/169.3

(Continued)

FOREIGN PATENT DOCUMENTS

CN 101290741 A 10/2008
CN 102063861 A 5/2011
CN 203085133 U 7/2013

(Continued)

OTHER PUBLICATIONS

International Search Report and Written Opinion of the International Searching Authority with Notice of Transmittal of the International Search Report and Written Opinion of PCT/CN2014/080897 in Chinese, mailed Sep. 2, 2014.

(Continued)

*Primary Examiner* — Alexander Eisen
*Assistant Examiner* — Nelson Lam
(74) *Attorney, Agent, or Firm* — Collard & Roe, P.C.

(57) ABSTRACT

A pixel circuit for AC driving, a driving method and a display apparatus relate to the field of display manufacture, and are capable of removing effect of internal resistance of a power supply line on the current for light-emitting and effect of the threshold voltage of the driving transistor on the display nonuniformity of a panel while effectively avoiding rapid aging of OLED. The pixel circuit comprises: a capacitor (C1), a first voltage input unit (11), a second voltage input unit (12), a data signal input unit (13), a first light emitting unit (14), a second light emitting unit (15) and a light emitting control unit (16). The present disclosure can be applied in display manufacture.

17 Claims, 11 Drawing Sheets

(56) References Cited

U.S. PATENT DOCUMENTS

| | | | | |
|---|---|---|---|---|
| 2007/0279339 | A1 | 12/2007 | Huang et al. | |
| 2008/0259064 | A1 | 10/2008 | Chiou | |
| 2011/0115835 | A1 | 5/2011 | Lee | |
| 2012/0306843 | A1 | 12/2012 | Wang et al. | |
| 2014/0002515 | A1* | 1/2014 | Huang | G09G 3/3233 345/691 |
| 2015/0287359 | A1* | 10/2015 | Qing | G09G 3/3233 345/214 |
| 2016/0019836 | A1* | 1/2016 | Qing | G09G 3/3233 345/76 |

FOREIGN PATENT DOCUMENTS

| | | | |
|---|---|---|---|
| CN | 103366682 | A | 10/2013 |
| CN | 103531148 | A | 1/2014 |
| JP | 2008122498 | A | 5/2008 |

OTHER PUBLICATIONS

English translation of the International Preliminary Report on Patentability and Written Opinion of the International Searching Authority of PCT/CN2014/080897, issued May 3, 2016.

* cited by examiner

PIXEL CIRCUIT FOR AC DRIVING, DRIVING METHOD AND DISPLAY APPARATUS

CROSS REFERENCE TO RELATED APPLICATIONS

This application is the National Stage of PCT/CN2014/080897 filed on Jun. 26, 2014, which claims priority under 35 U.S.C. §119 of Chinese Application No. 201310529546.1 filed on Oct. 31, 2013, the disclosure of which is incorporated by reference.

TECHNICAL FIELD OF THE DISCLOSURE

The present disclosure relates to a pixel circuit for AC driving, a driving method and a display apparatus.

BACKGROUND

An AMOLED (Active Matrix Organic Light-Emitting Diode) is able to emit light as it is driven by a current generated by a driving TFT (Thin Film Transistor) in saturation. Different TFTs may have different threshold voltages and may generate different driving currents due to their different threshold voltages when a same gray level voltage is input, thus rendering the nonuniformity of the driving currents. Under the LTPS (Low Temperature Poly-silicon) manufacturing process, the threshold voltages Vth of TFTs have a poor uniformity and may have drifts as well, such that the uniformity in luminance of the AMOLED adopting the conventional 2T1C circuit is always poor. Another factor which has an effect on the uniformity in brightness lies in that the power supply line has an internal resistance and OLED (Organic Light-Emitting Diode) is a light emitting device driven by a current, a voltage drop is generated on the internal resistance of the power supply line when there is a current flowing through OLED, which renders that power supply voltages at different locations cannot reach the required voltage.

In addition, aging problem of OLED is a common problem that all of the OLED light-emitting displays have to be faced with. DC driving is mostly adopted in the prior art, wherein the transmission directions of holes and electrons are fixed, the holes and electrons are injected to a light-emitting layer from a positive pole and a negative pole, respectively, and then excitons are formed in the light-emitting layer to radiate luminescent. Redundant holes (or electrons) which are not combined are accumulated at an interface between a hole transmission layer and the light-emitting layer (or an interface between the light-emitting layer and an electron transmission layer), or flow to the pole across potential barrier. With prolong of the operation time, carriers not combined but accumulated at internal interfaces of the light-emitting layer allow that an built-in electric field is formed inside the OLED, which renders that the threshold voltage of the OLED increases continuously, the luminance of the OLED decreases continuously, and the energy utilization efficiency of the OLED decreases continuously. An AC driving circuit of OLED has been proposed in the prior art, which achieves AC driving for the OLED and solves the aging problem of the OLED, but cannot remove the effect of the internal resistance of the power supply line and the threshold voltage of the driving transistor on the display nonuniformity of the AMOLED.

SUMMARY

In order to solve the above technical problem, there are provided a pixel circuit for AC driving, a driving method and a display apparatus in embodiments of the present disclosure capable of removing the effect of the internal resistance of the power supply line on the current for light-emitting and the effect of the threshold voltage of the driving transistor on the display nonuniformity of the AMOLED while effectively avoiding the rapid aging of the OLED.

In accordance with one aspect of the present disclosure, there is provided a pixel circuit for AC driving comprising: a capacitor, a first voltage input unit, a second voltage input unit, a data signal input unit, a first light emitting unit, a second light emitting unit and a light emitting control unit. The first light emitting unit is configured to emit light under the control of a driving control terminal, a first light emitting control terminal, a first voltage input terminal and a second voltage input terminal; the second light emitting unit is configured to emit light under the control of the driving control terminal, a second light emitting control terminal, the first voltage input terminal and the second voltage input terminal; wherein the first light emitting unit emits light during a preset first time period and the second light emitting unit emits light during a preset second time period.

The first voltage input unit is configured to supply a first input voltage at a first voltage terminal to the first light emitting unit and the second light emitting unit under the control of a first scan terminal; the second voltage input unit is configured to supply a second input voltage at a second voltage terminal to the first light emitting unit and the second light emitting unit under the control of the first scan terminal.

The data signal input unit is configured to supply a data line signal to the first voltage input terminal through a data line under the control of a second scan terminal. The light emitting control unit is used to make the first light emitting unit or the second light emitting unit emit light by aid of the driving control terminal, the first light emitting control terminal and the second light emitting control terminal under the control of a third scan terminal; a first electrode of the capacitor is connected to the first voltage terminal and a second electrode of the capacitor is connected to the driving control terminal.

Optionally, the first voltage input unit comprises a first switching transistor having a gate connected to the first scan terminal, a source connected to the first voltage terminal, and a drain connected to the first voltage input terminal.

Optionally, the data signal input unit comprises a second switching transistor having a gate connected to the second scan terminal, a source connected to the data line, and a drain connected to the first voltage input terminal.

Optionally, the light emitting control unit comprises a third switching transistor having a gate connected to the third scan terminal, a source connected to the driving control terminal, and a drain connected to the first light emitting control terminal and the second light emitting control terminal.

Optionally, the second voltage input unit comprises a fourth switching transistor having a gate connected to the first scan terminal, a source connected to the second voltage terminal, and a drain connected to the second voltage input terminal.

Optionally, the light emitting control unit comprises a third switching transistor and a fifth switching transistor, the third switching transistor has a gate connected to the third scan terminal, a source connected to the driving control terminal and a drain connected to the first light emitting control terminal, and the fifth switching transistor has a gate connected to the third scan terminal, a source connected to the driving control terminal and a drain connected to the second light emitting control terminal.

Optionally, the first light emitting unit comprises a first driving transistor and a first light emitting diode. The first driving transistor has a gate connected to the driving control terminal, a source connected to the first voltage input terminal and a drain connected to the first light emitting control terminal. The first light emitting diode has a first electrode connected to the first light emitting control terminal and a second electrode connected to the second voltage input terminal. The second light emitting unit comprises a second driving transistor and a second light emitting diode. The second driving transistor has a gate connected to the driving control terminal, a source connected to the first voltage input terminal and a drain connected to the second light emitting control terminal. The second light emitting diode has a first electrode connected to the second voltage input terminal and a second electrode connected to the second light emitting control terminal. The first driving transistor and the second driving transistor are of different types.

Optionally, the first light emitting unit emits light during a preset high level period supplied at the first voltage terminal and during a preset low level period supplied at the second voltage terminal, and the second light emitting unit emits light during a preset low level period supplied at the first voltage terminal and during a preset high level period supplied at the second voltage terminal.

In accordance with another aspect of the present disclosure, there is provided a display apparatus comprising any one of the above pixel circuits.

In accordance with another aspect of the present disclosure, there is provided a driving method of pixel circuit comprising: during a first stage, controlling a first voltage input unit and a second voltage input unit to operate by aid of a first scan terminal such that a first voltage input terminal is connected to a first voltage terminal and a second voltage input terminal is connected to a second voltage terminal, controlling a data signal input unit to operate by aid of a second scan terminal and controlling a light emitting control unit to operate by aid of a third scan terminal such that voltage at a driving control terminal is reset; during a second stage, controlling the first voltage input unit and the second voltage input unit to close by aid of the first scan terminal, controlling the data signal input unit to operate by aid of the second scan terminal and controlling the light emitting control unit to operate by aid of the third scan terminal such that a capacitor is charged by a data line; during a third stage, controlling the first voltage input unit and the second voltage input unit to close by aid of the first scan terminal, controlling the data signal input unit to close by aid of the second scan terminal and controlling the light emitting control unit to operate by aid of the third scan terminal; during a fourth stage, controlling the first voltage input unit and the second voltage input unit to operate by aid of the first scan terminal, controlling the data signal input unit to close by aid of the second scan terminal and controlling the light emitting control unit to close by aid of the third scan terminal such that a first light emitting unit is driven to emit light by aid of the driving control terminal, a first light emitting control terminal, the first voltage input terminal and the second voltage input terminal; during a fifth stage, controlling the first voltage input unit and the second voltage input unit to operate by aid of the first scan terminal such that the first voltage input terminal is connected to the first voltage terminal and the second voltage input terminal is connected to the second voltage terminal, controlling the data signal input unit to operate by aid of the second scan terminal and controlling the light emitting control unit to operate by aid of the third scan terminal such that the voltage at the driving control terminal is reset; during a sixth stage, controlling the first voltage input unit and the second voltage input unit to close by aid of the first scan terminal, controlling the data signal input unit to operate by aid of the second scan terminal and controlling the light emitting control unit to operate by aid of the third scan terminal such that the capacitor is charged by the data line; during a seventh stage, controlling the first voltage input unit and the second voltage input unit to close by aid of the first scan terminal, controlling the data signal input unit to close by aid of the second scan terminal and controlling the light emitting control unit to operate by aid of the third scan terminal; and during an eighth stage, controlling the first voltage input unit and the second voltage input unit to operate by aid of the first scan terminal, controlling the data signal input unit to close by aid of the second scan terminal and controlling the light emitting control unit to close by aid of the third scan terminal such that a second light emitting unit is driven to emit light by aid of the driving control terminal, a second light emitting control terminal, the first voltage input terminal and the second voltage input terminal.

Optionally, during the first stage, a first switching transistor, a second switching transistor, a third switching transistor, a fourth switching transistor and a first driving transistor are turned on, and a second driving transistor is turned off; during the second stage, the first switching transistor, the fourth switching transistor and the second driving transistor are turned off, and the second switching transistor, the third switching transistor and the first driving transistor are turned on; during the third stage, the first switching transistor, the second switching transistor, the third switching transistor and the fourth switching transistor are turned off, and the first driving transistor and the second driving transistor are turned off; during the fourth stage, the first switching transistor, the fourth switching transistor and the first driving transistor are turned on, and the second switching transistor, the third switching transistor and the second driving transistor are turned off; during the fifth stage, the first switching transistor, the second switching transistor, the third switching transistor, the fourth switching transistor and the second driving transistor are turned on, and the first driving transistor is turned off; during the sixth stage, the first switching transistor, the fourth switching transistor and the first driving transistor are turned off, and the second switching transistor, the third switching transistor and the second driving transistor are turned on; during the seventh stage, the first switching transistor, the second switching transistor, the third switching transistor and the fourth switching transistor are turned off, and the first driving transistor and the second driving transistor are turned off; and during the eighth stage, the first switching transistor, the fourth switching transistor and the second driving transistor are turned on, and the second switching transistor, the third switching transistor and the first driving transistor are turned off.

Optionally, the method further comprises: during the first stage, the fifth switching transistor is turned on; during the second stage, the fifth switching transistor is turned on; during the third stage, the fifth switching transistor is turned off; during the fourth stage, the fifth switching transistor is turned off; during the fifth stage, the fifth switching transistor is turned on; during the sixth stage, the fifth switching transistor is turned on; during the seventh stage, the fifth switching transistor is turned off; and during the eighth stage, the fifth switching transistor is turned off.

In the pixel circuit for AC driving, the driving method and the display apparatus proposed in the embodiments of the present disclosure, the AC driving of each pixel circuit can be achieved by arranging a compensation capacitor and two light emitting units which operate during different time periods respectively in the pixel circuit, thus removing the effect of the internal resistance of the power supply line on the current for light-emitting and the effect of the threshold voltage of the driving transistor on the display nonuniformity of the AMOLED while effectively avoiding the rapid aging of the OLED.

BRIEF DESCRIPTION OF THE DRAWINGS

In order to more clearly describe the technical solutions of the embodiments of the present disclosure or the prior art, drawings necessary for describing the embodiments of the present disclosure or the prior art are simply introduced as follows. It should be obvious for those skilled in the art that the drawings described as follows are only some embodiments of the present disclosure.

FIG. 1(*b*) is a schematic structure diagram of another pixel circuit for AC driving provided in the embodiment of the present disclosure;

FIG. 3(*b*) is a schematic structure diagram of a pixel circuit for AC driving provided in yet another embodiment of the present disclosure;

FIG. 8(*b*) is an equivalent circuit diagram of the pixel circuit for AC driving operating in a fourth stage provided in the embodiment of the present disclosure corresponding to FIG. 3(*a*);

FIG. 12(*b*) is an equivalent circuit diagram of the pixel circuit for AC driving operating in an eighth stage provided in the embodiment of the present disclosure corresponding to FIG. 3(*a*).

DETAILED DESCRIPTION

Hereinafter, the technical solutions in the embodiments of the present disclosure will be described clearly and thoroughly with reference to the accompanying drawings of the embodiments of the present disclosure. Obviously, the embodiments as described are only some of the embodiments of the present disclosure, and are not all of the embodiments of the present disclosure.

Switching transistors and driving transistors adopted in the embodiments of the present disclosure may be Thin Film Transistors or Field Effect Transistors or other devices having the same characteristics. Sources and drains of the switching transistors adopted in the embodiments of the present disclosure are interchangeable since the sources and the drains are symmetric in structure. In the embodiments of the present disclosure, in order to distinguish the two electrodes other than the gate of a transistor, one of the two electrodes is referred to as a source and the other is referred to a drain. According to the appearance form in the accompanying drawings, it is prescribed that a middle terminal of a transistor is a gate, a signal input terminal is a source and a signal output terminal is a drain. In addition, the transistors adopted in the embodiments of the present disclosure may comprise P type transistors and N type transistors, wherein each of the P type transistors is turned on when its gate is at a low level and turned off when its gate is at a high level, and each of the N type transistors is turned on when its gate is at a high level and turned off when its gate is at a low level. The term of "turn on" can also be replaced by "switch on" or "operate" in the technical field to represent a corresponding function in the embodiments of the present disclosure, and the term of "turn off" can also be replace by "switch off" in the technical field to represent a corresponding function in the embodiments of the present disclosure.

Figure 1A:
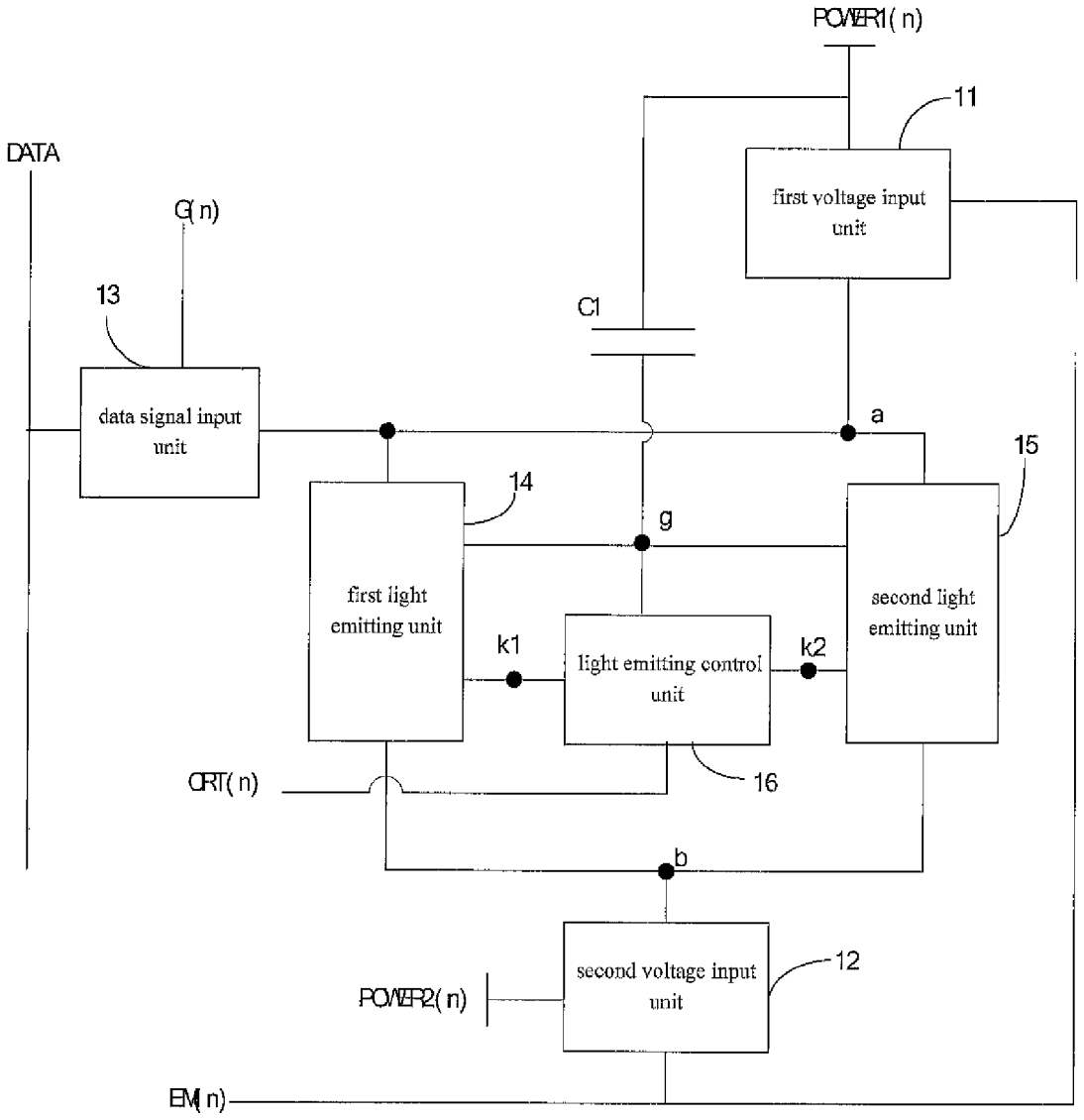
FIG. 1(*a*) is a schematic structure diagram of a pixel circuit for AC driving provided in an embodiment of the present disclosure.
Figure 1B:
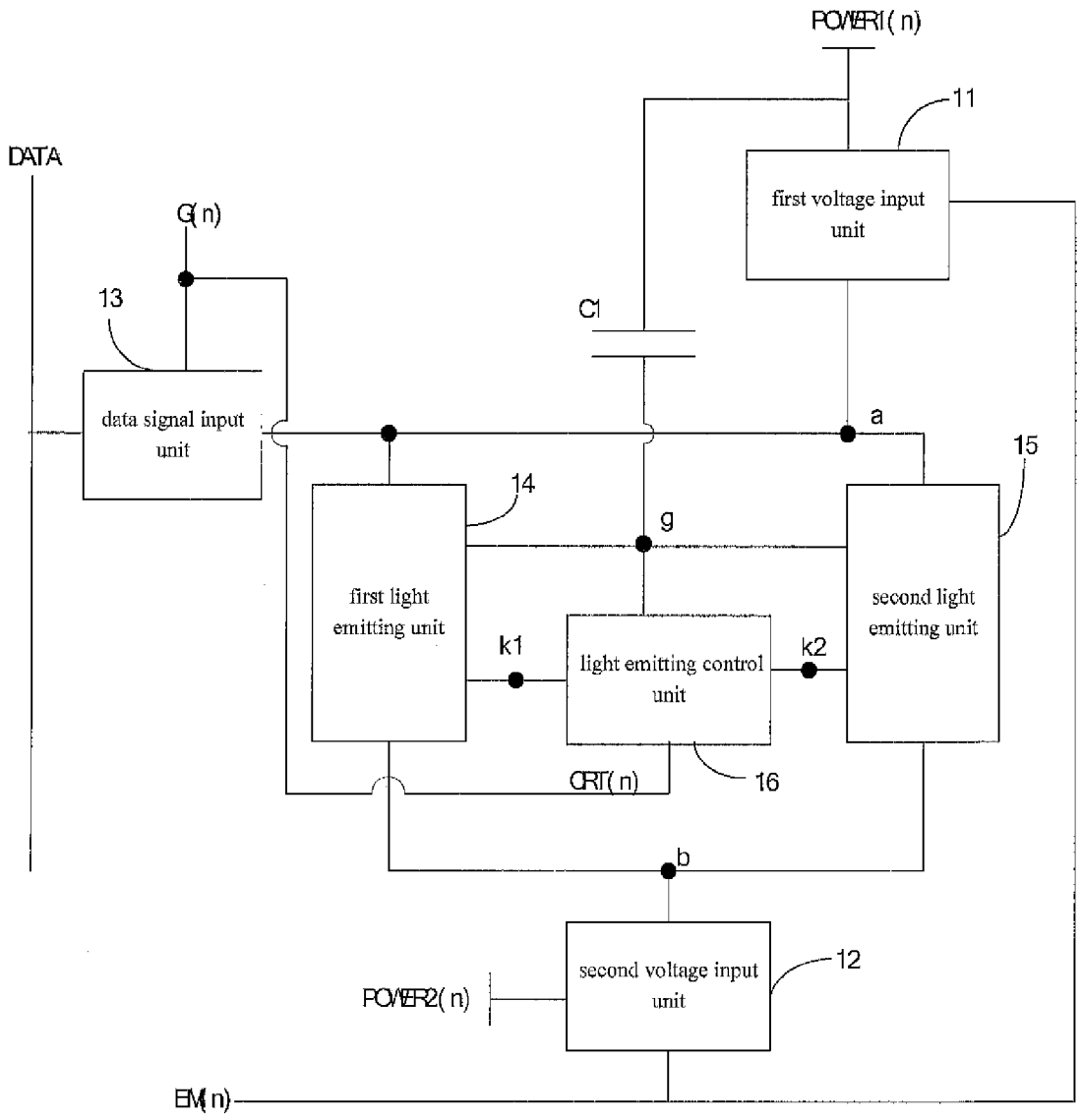

With reference to FIG. 1(*a*), a pixel circuit for AC driving in accordance with embodiments of the present disclosure comprises: a capacitor C1, a first voltage input unit 11, a second voltage input unit 12, a data signal input unit 13, a first light emitting unit 14, a second light emitting unit 15 and a light emitting control unit 16.

The first light emitting unit 14 is connected to a first voltage input terminal a, a second voltage input terminal b, a driving control terminal g and a first light emitting control terminal k1, and is configured to emit light under the control of the driving control terminal g, the first light emitting control terminal k1, the first voltage input terminal a and the second voltage input terminal b.

The second light emitting unit 15 is connected to the first voltage input terminal a, the second voltage input terminal b, the driving control terminal g and a second light emitting control terminal k2, and is configured to emit light under the control of the driving control terminal g, the second light emitting control terminal k2, the first voltage input terminal a and the second voltage input terminal b. The first light emitting unit 14 emits light during a preset first time period and the second light emitting unit 15 emits light during a preset second time period.

The first voltage input unit 11 is connected to a first voltage terminal POWER1(*n*), the first voltage input terminal a and a first scan terminal EM(n); and is configured to supply a first input voltage at the first voltage terminal POWER1(*n*) to the first light emitting unit 14 and the second light emitting unit 15 under the control of the first scan terminal EM(n).

The second voltage input unit 12 is connected to a second voltage terminal POWER2(*n*), the second voltage input terminal b and the first scan terminal EM(n); and is configured to supply a second input voltage at the second voltage terminal POWER2(*n*) to the first light emitting unit 14 and the second light emitting unit 15 under the control of the first scan terminal EM(n).

The data signal input unit 13 is connected to a data line DATA, a second scan terminal G(n) and the first voltage input terminal a, and is configured to supply a data line signal to the first voltage input terminal a through the data line DATA under the control of the second scan terminal G(n).

The light emitting control unit 16 is connected to the driving control terminal g, the first light emitting control terminal k1, the second light emitting control terminal k2 and a third scan terminal CRT(n), and is configured to control the first light emitting unit 14 or the second light emitting unit 15 emit light by aid of the driving control terminal g, the first light emitting control terminal k1 and the second light emitting control terminal k2 under the control of the third scan terminal CRT(n).

A first electrode of the capacitor C1 is connected to the first voltage terminal POWER1(*n*) and a second electrode of the capacitor C1 is connected to the driving control terminal g.

The first time period and the second time period can be two adjacent data frames but not limited thereto. The first time period and the second time period can be set according to requirement. Commonly, "a data frame (simply referred to as a frame)" is the time of "a display period" and is about several to tens milliseconds.

In the pixel circuit for AC driving provided in the embodiments of the present disclosure, the AC driving of each pixel circuit can be achieved by arranging a compensation capacitor and two light emitting units which operate during different time periods respectively in the pixel circuit, thus removing the effect of the internal resistance of the power supply line on the current for light-emitting and the effect of the threshold voltage of the driving transistor on the display nonuniformity of the AMOLED while effectively avoiding the rapid aging of the OLED.

Preferably, in order to reduce signal lines, the second scan terminal G(n) and the third scan terminal CRT(n) can be connected to a same scan terminal, that is, the second scan terminal G(n) and the third scan terminal CRT(n) receive signal from a same scan line G(n), as shown in FIG. 1(*b*).

Figure 2:
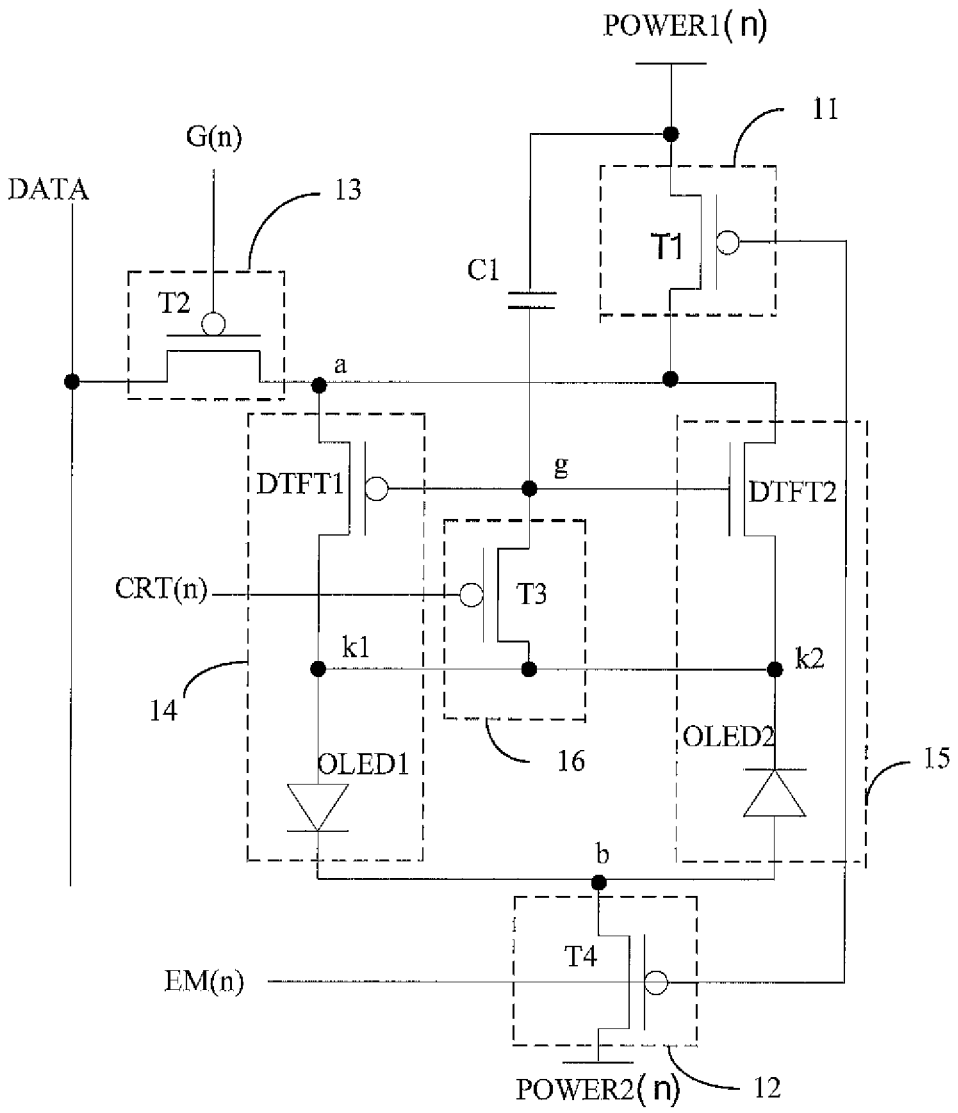
FIG. 2 is a schematic structure diagram of a pixel circuit for AC driving provided in another embodiment of the present disclosure.

As shown in FIG. 2, a pixel circuit for AC driving provided in the embodiments of the present disclosure comprises: a capacitor C1, a first voltage input unit 11, a second voltage input unit 12, a data signal input unit 13, a first light emitting unit 14, a second light emitting unit 15 and a light emitting control unit 16.

The first voltage input unit 11 comprises a first switching transistor T1 having a gate connected to the first scan terminal EM(n), a source connected to the first voltage terminal POWER1(*n*), and a drain connected to the first voltage input terminal a.

The data signal input unit 13 comprises a second switching transistor T2 having a gate connected to the second scan terminal G(n), a source connected to the data line DATA, and a drain connected to the first voltage input terminal a.

The light emitting control unit 16 comprises a third switching transistor T3 having a gate connected to the third scan terminal CRT(n), a source connected to the driving control terminal g, and a drain connected to the first light emitting control terminal k1 and the second light emitting control terminal k2.

The second voltage input unit 12 comprises a fourth switching transistor T4 having a gate connected to the first scan terminal EM(n), a source connected to the second voltage terminal POWER2(*n*), and a drain connected to the second voltage input terminal b.

The first light emitting unit 14 comprises a first driving transistor DTFT1 and a first light emitting diode OLED1.

The first driving transistor DTFT1 has a gate connected to the driving control terminal g, a source connected to the first voltage input terminal a and a drain connected to the first light emitting control terminal k1.

The first light emitting diode OLED1 has a first electrode connected to the first light emitting control terminal k1 and a second electrode connected to the second voltage input terminal b.

The second light emitting unit 15 comprises a second driving transistor DTFT2 and a second light emitting diode OLED2.

The second driving transistor DTFT2 has a gate connected to the driving control terminal g, a source connected to the first voltage input terminal a and a drain connected to the second light emitting control terminal k2.

The second light emitting diode OLED2 has a first electrode connected to the second voltage input terminal b and a second electrode connected to the second light emitting control terminal k2.

The first driving transistor DTFT1 and the second driving transistor DTFT2 are of different types. For example, the first driving transistor DTFT1 is a N type transistor and the second driving transistor DTFT2 is a P type transistor.

The first light emitting unit emits light during a preset high level period or a preset low level period supplied at the first voltage terminal POWER1(*n*) and the second voltage terminal POWER2(*n*), and the second light emitting unit emits light during a preset low level period or a preset high level period supplied at the first voltage terminal POWER1(*n*) and the second voltage terminal POWER2(*n*).

Optionally, when alternating current is supplied, the first light emitting unit emits light during a positive half cycle or a negative half cycle of the alternating current supplied at the first voltage terminal POWER1(*n*) and the second voltage terminal POWER2(*n*), and the second light emitting unit emits light during a negative half cycle or a positive half cycle of the alternating current supplied at the first voltage terminal POWER1(*n*) and the second voltage terminal POWER2(*n*). That is, the first light emitting unit emits light during a positive half cycle of the alternating current, and the second light emitting unit emits light during a negative half cycle of the alternating current. Alternatively, the first light emitting unit emits light during a negative half cycle of the alternating current when the second light emitting unit emits light during a positive half cycle of the alternating current. Particularly, the alternating current can be supplied in the following manner: the voltage at the first voltage terminal POWER1(*n*) and the voltage at the second voltage terminal POWER2(*n*) jump to their reverse voltages, respectively, when the current pixel circuit changes its output from the current frame to a next frame.

Figure 3A:
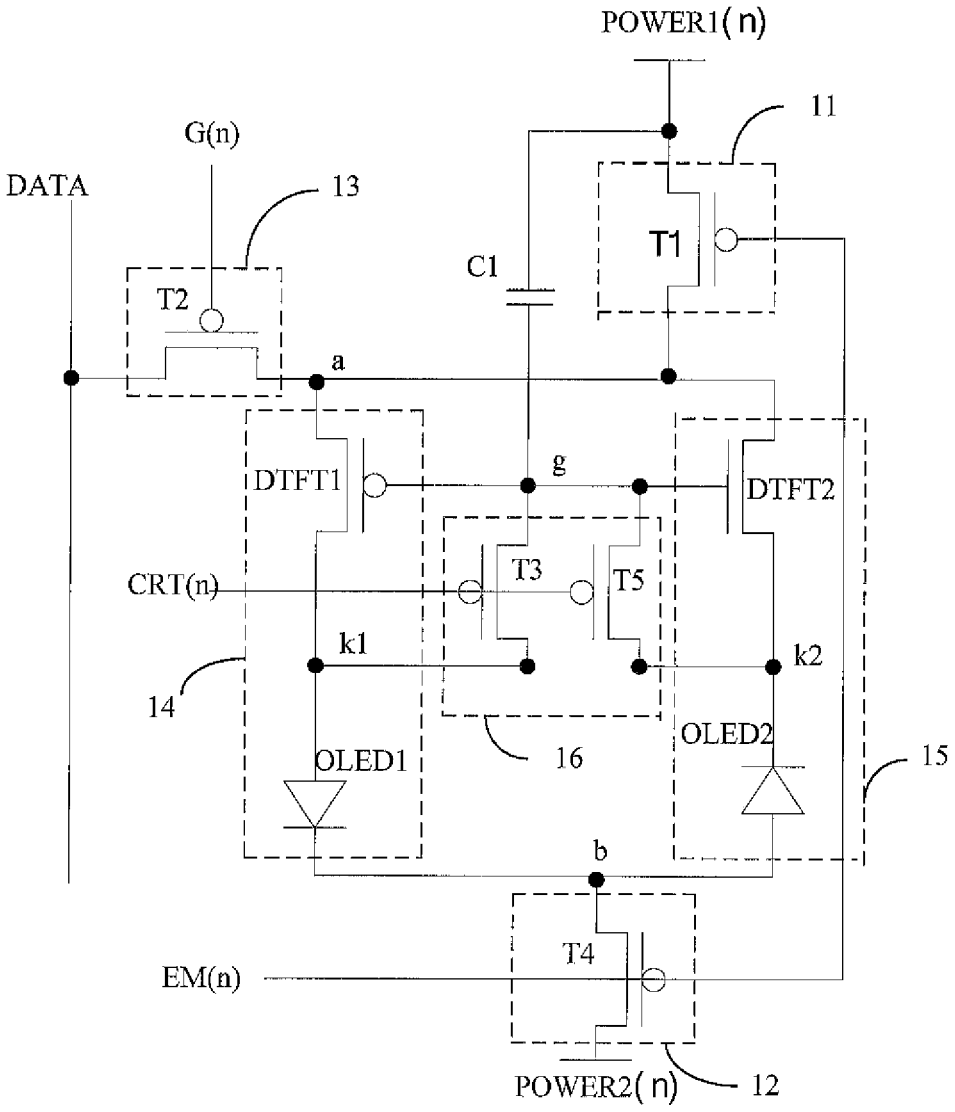
FIG. 3(*a*) is a schematic structure diagram of a pixel circuit for AC driving provided in another embodiment of the present disclosure.
Figure 3B:
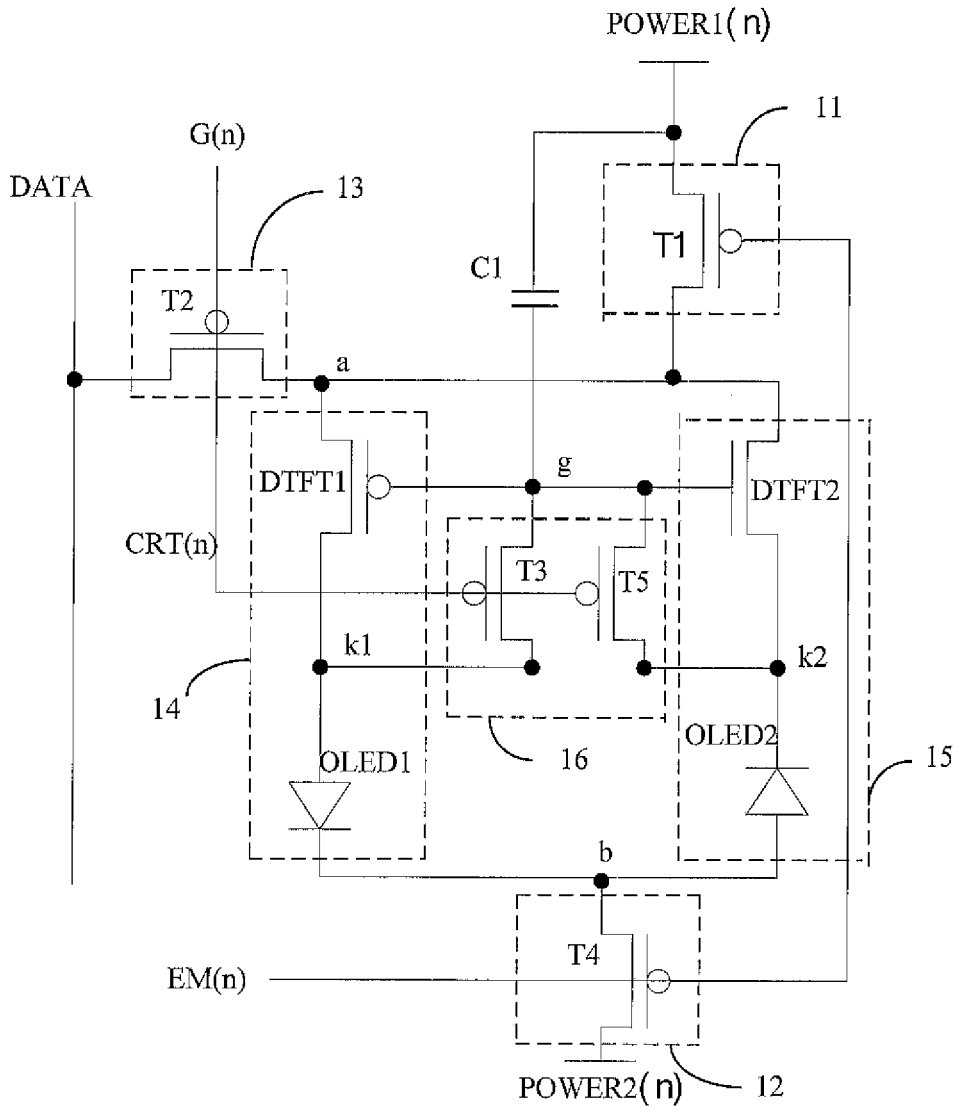

Optionally, with reference to FIG. 3(*a*), different from FIG. 2, the light emitting control unit 16 comprises a third switching transistor T3 and a fifth switching transistor T5, the third switching transistor T3 has a gate connected to the third scan terminal CRT(n), a source connected to the driving control terminal g and a drain connected to the first light emitting control terminal k1.

The fifth switching transistor T5 has a gate connected to the third scan terminal CRT(n), a source connected to the driving control terminal g and a drain connected to the second light emitting control terminal k2.

In accordance with the embodiments of the present disclosure, there is provided a display apparatus comprising the above pixel circuit.

In the display apparatus provided in the embodiments of the present disclosure, the AC driving of each pixel circuit can be achieved by arranging a compensation capacitor and two light emitting units which operate during different time periods respectively in the pixel circuit, thus removing the effect of the internal resistance of the power supply line on the current for light-emitting and the effect of the threshold voltage of the driving transistor on the display nonuniformity of the AMOLED while effectively avoiding the rapid aging of the OLED.

In accordance with the embodiments of the present disclosure, there is provided a driving method of pixel circuit which comprises eight stages.

During a first stage, a first voltage input unit 11 and a second voltage input unit 12 are controlled to operate by aid of a first scan terminal EM(n) such that a first voltage input terminal a is connected to a first voltage terminal POWER1(*n*) and a second voltage input terminal b is connected to a second voltage terminal POWER2(*n*), a data signal input unit 13 is controlled to operate by aid of a second scan terminal G(n) and a light emitting control unit 16 is controlled to operate by aid of a third scan terminal CRT(n) such that voltage at a driving control terminal g is reset.

During a second stage, the first voltage input unit 11 and the second voltage input unit 12 are controlled to close by aid of the first scan terminal EM(n), the data signal input unit 13 is controlled to operate by aid of the second scan terminal G(n) and the light emitting control unit 16 is controlled to operate by aid of the third scan terminal CRT(n) such that a capacitor is charged by a data line DATA.

During a third stage, the first voltage input unit 11 and the second voltage input unit 12 are controlled to close by aid of the first scan terminal EM(n), the data signal input unit 13 is controlled to close by aid of the second scan terminal G(n) and the light emitting control unit 16 is controlled to operate by aid of the third scan terminal CRT(n).

During a fourth stage, the first voltage input unit 11 and the second voltage input unit 12 are controlled to operate by aid of the first scan terminal EM(n), the data signal input unit 13 is controlled to close by aid of the second scan terminal G(n) and the light emitting control unit 16 is controlled to close by aid of the third scan terminal CRT(n) such that a first light emitting unit 14 is driven to emit light by aid of the driving control terminal g, a first light emitting control terminal k1, the first voltage input terminal a and the second voltage input terminal b.

During a fifth stage, the first voltage input unit 11 and the second voltage input unit 12 are controlled to operate by aid of the first scan terminal EM(n) such that the first voltage input terminal a is connected to the first voltage terminal POWER1(*n*) and the second voltage input terminal b is connected to the second voltage terminal POWER2(*n*), the data signal input unit 13 is controlled to operate by aid of the second scan terminal G(n) and the light emitting control unit 16 is controlled to operate by aid of the third scan terminal CRT(n) such that the voltage at the driving control terminal g is reset.

During a sixth stage, the first voltage input unit 11 and the second voltage input unit 12 are controlled to close by aid of the first scan terminal EM(n), the data signal input unit 13 is controlled to operate by aid of the second scan terminal G(n) and the light emitting control unit 16 is controlled to operate by aid of the third scan terminal CRT(n) such that the capacitor is charged by the data line DATA.

During a seventh stage, the first voltage input unit 11 and the second voltage input unit 12 are controlled to close by aid of the first scan terminal EM(n), the data signal input unit 13 is controlled to close by aid of the second scan terminal G(n) and the light emitting control unit 16 is controlled to operate by aid of the third scan terminal CRT(n).

During an eighth stage, the first voltage input unit 11 and the second voltage input unit 12 are controlled to operate by aid of the first scan terminal EM(n), the data signal input unit 13 is controlled to close by aid of the second scan terminal G(n) and the light emitting control unit 16 is controlled to close by aid of the third scan terminal CRT(n) such that a second light emitting unit 15 is driven to emit light by aid of the driving control terminal g, a second light emitting control terminal k2, the first voltage input terminal a and the second voltage input terminal b.

Optionally, when a $N^{th}$ frame arrives, the driving method comprises the following first to fourth stages.

During the first stage, a first switching transistor T1, a second switching transistor T2, a third switching transistor T3, a fourth switching transistor T4 and a first driving transistor DTFT1 are turned on, and a second driving transistor DTFT2 is turned off.

During the second stage, the first switching transistor T1, the fourth switching transistor T4 and the second driving transistor DTFT2 are turned off, and the second switching transistor T2, the third switching transistor T3 and the first driving transistor DTFT1 are turned on.

During the third stage, the first switching transistor T1, the second switching transistor T2, the third switching transistor T3 and the fourth switching transistor T4 are turned off, and the first driving transistor DTFT1 and the second driving transistor DTFT2 are turned off.

During the fourth stage, the first switching transistor T1, the fourth switching transistor T4 and the first driving transistor DTFT1 are turned on, and the second switching transistor T2, the third switching transistor T3 and the second driving transistor DTFT2 are turned off.

When a $N+1^{th}$ frame arrives, the driving method comprises the following fifth to eighth stages.

During the fifth stage, the first switching transistor T1, the second switching transistor T2, the third switching transistor T3, the fourth switching transistor T4 and the second driving transistor DTFT2 are turned on, and the first driving transistor DTFT1 is turned off.

During the sixth stage, the first switching transistor T1, the fourth switching transistor T4 and the first driving transistor DTFT1 are turned off, and the second switching transistor T2, the third switching transistor T3 and the second driving transistor DTFT2 are turned on.

During the seventh stage, the first switching transistor T1, the second switching transistor T2, the third switching transistor T3 and the fourth switching transistor T4 are turned off, and the first driving transistor DTFT1 and the second driving transistor DTFT2 are turned off.

During the eighth stage, the first switching transistor T1, the fourth switching transistor T4 and the second driving transistor DTFT2 are turned on, and the second switching transistor T2, the third switching transistor T3 and the first driving transistor DTFT1 are turned off.

Furthermore, as shown in FIG. 3(*a*), in case that the light emitting control unit 16 comprises the third switching transistor T3 and the fifth switching transistor T5, the first to eighth stage of the driving method should further comprise the operation of the fifth switching transistor T5.

Particularly, when the $N^{th}$ frame arrives, during the first stage, the fifth switching transistor T5 is turned on; during the second stage, the fifth switching transistor T5 is turned on; during the third stage, the fifth switching transistor T5 is turned off; during the fourth stage, the fifth switching transistor T5 is turned off.

When the $N+1^{th}$ frame arrives, during the fifth stage, the fifth switching transistor T5 is turned on; during the sixth stage, the fifth switching transistor T5 is turned on; during the seventh stage, the fifth switching transistor T5 is turned off; and during the eighth stage, the fifth switching transistor T5 is turned off.

In the driving method provided in the embodiments of the present disclosure, the AC driving of each pixel circuit can be achieved by arranging a compensation capacitor and two light emitting units which operate during different time periods respectively in the pixel circuit, thus removing the effect of the internal resistance of the power supply line on the current for light-emitting and the effect of the threshold voltage of the driving transistor on the display nonuniformity of the AMOLED while effectively avoiding the rapid aging of the OLED.

The above first scan terminal, the above second scan terminal and the above third scan terminal can be supplied power in a separate manner, or can be supplied power in a manner of scan lines, or can be supplied power in any combination manner of the above two manners.

Preferably, in order to reduce signal lines, the second scan terminal and the third scan terminal can be connected to a same scan terminal, that is, the second scan terminal and the third scan terminal can receive signal from a same scan line. As shown in FIG. 1(*b*) and FIG. 3(*b*), signal at the second scan terminal G(n) and signal at the third scan terminal CRT(n) are a same signal at the same scan line G(n).

The following specific embodiments will be described in the manner of scan lines, that is, the first scan line functions as the first scan terminal, the second scan line functions as the second scan terminal, and the third scan line functions as the third scan terminal, so as to supply and input control signals to the circuit in accordance with the embodiments of the present disclosure.

Figure 4:
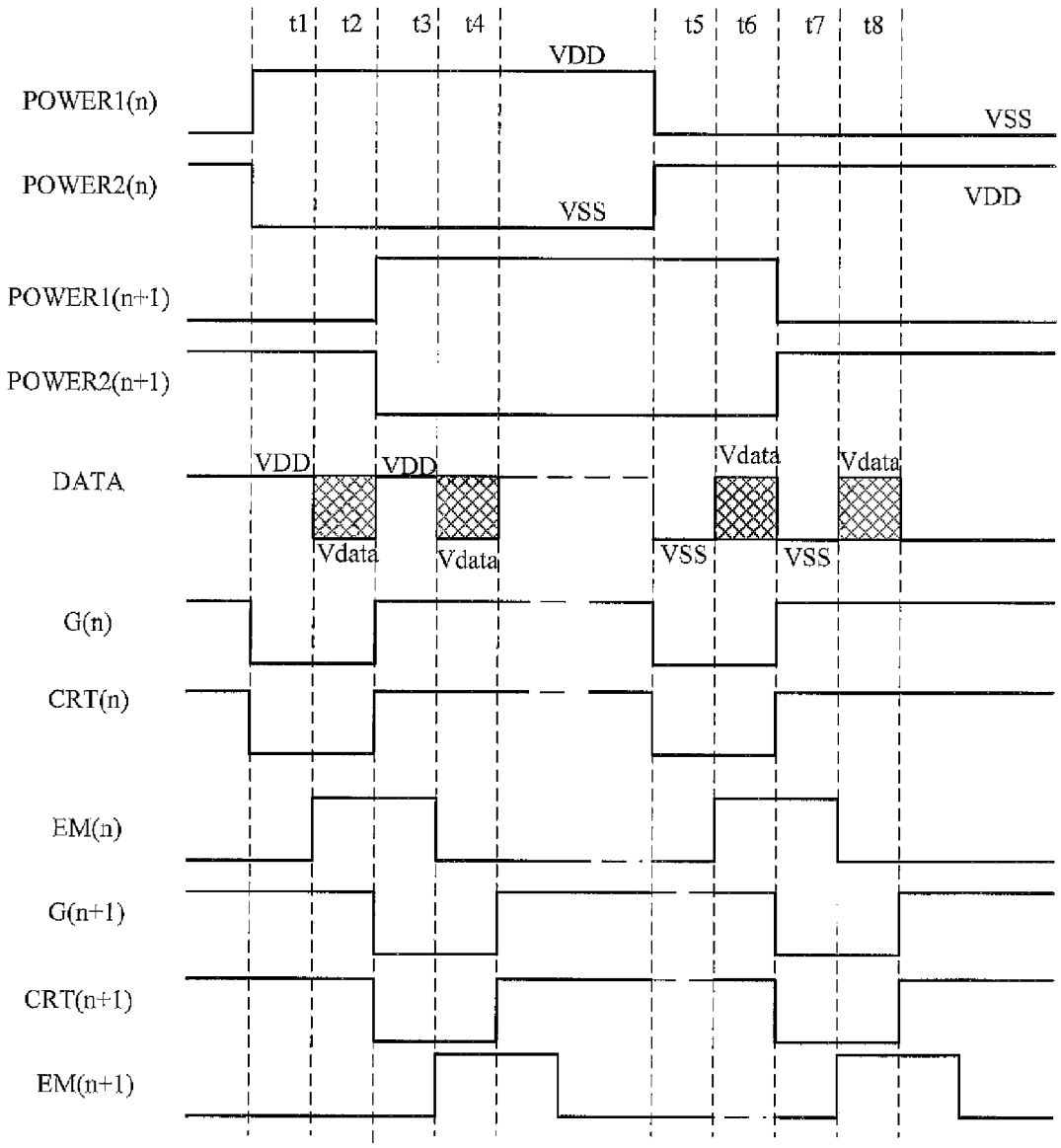
FIG. 4 is a schematic diagram of timing sequence states of input signals of the pixel circuit for AC driving provided in the embodiments of the present disclosure.

Particularly, the pixel driving method provided in the embodiments of the present disclosure will be described in detail by combining the timing sequence state diagram as shown in FIG. 4 and the pixel circuit as shown in FIG. 2 or FIG. 3 and taking the case that the first time period and the second time period are two adjacent data frames ($N^{th}$ and $N+1^{th}$) as an example.

FIG. 3(*a*) is a principal diagram of a pixel driving circuit in accordance with the embodiments of the present disclosure. The structure of the circuit as a whole comprises five switching transistors (T1-T5), two driving transistors DTFT1 and DTFT2, a capacitor C and two light emitting diodes OLED1 and OLED2, wherein DTFT1 is of P type, DTFT2 is of N type, T1-T5 are all P type switching transistors. It should be understood that a light emitting diode comprises a cathode and an anode and thus a first electrode and a second electrode of each of the above light emitting diodes are a cathode and an anode of the light emitting diode and are connected to the drain of the driving transistor according to specific requirement. In the present embodiment, the first electrode of the light emitting diode is the anode and the second electrode of the light emitting diode is the cathode. For each row, there are a first scan signal EM(n) for controlling light-emitting, a second scan signal G(n), a third scan signal CRT(n), two power supply signals supplied from a first voltage terminal POWER1(*n*) and a second voltage terminal POWER2(*n*) respectively, and a data line DATA. It should be noted that each single pixel circuit should be controlled by individual power supply signals, and the power supply signals (the first voltage terminal POWER1 and the second voltage terminal POWER2) for each single pixel circuit should flip over. With reference to FIG. 4, power supplies for the current pixel circuit are supplied from the first voltage terminal POWER1(*n*) and the second voltage terminal POWER2(*n*), and power supplies for the pixel circuit of a next stage are supplied from the first voltage terminal POWER1(*n*+1) and the second voltage terminal POWER2(*n*+1). FIG. 4 further shows the first scan line signal EM(n), the second scan line signal G(n) and the third scan line signal CRT(n) for the current pixel circuit and the first scan line signal EM(n+1), the second scan line signal G(n+1) and the third scan line signal CRT(n+1) for the pixel circuit of the next stage, wherein the operation of the pixel circuit for each row is divided into four stages (as shown in FIG. 4, t1-t4 for the current frame and t5-t8 for the next frame). Since the light-emitting driving for two adjacent frames are performed alternately by symmetric portions in the pixel circuit, the operation of the circuit in each of total eight stages for the two adjacent frames will be described, but the operation of the circuit itself only needs four stages. The ON level of the switching transistor is a high level VGH and the OFF level of the switching transistor is VGL. A high level of the power supplies is VDD and a low level of the power supplies is VSS. Of course, the explanation is given by taking P type switching transistors as an example. When N type switching transistors are adopted, the timing sequence of the signal at the gate should be adjusted only if the switching transistors in the embodiments of the present disclosure can achieve the switching function in the method claims.

The specific timing sequence diagram of the circuit is as shown in FIG. 4 and the operation in the four stages of the $N^{th}$ frame is as follows.

Figure 5:
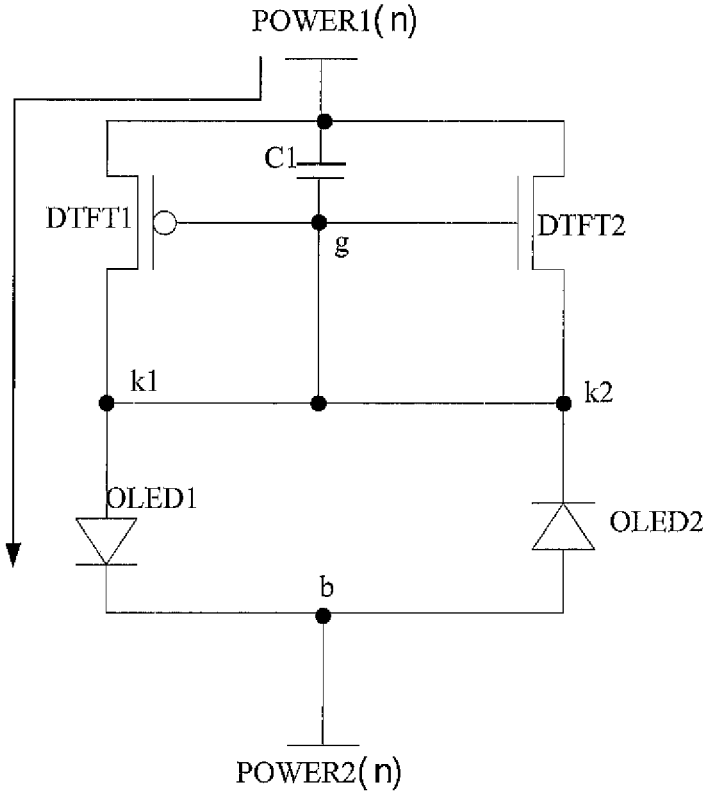
FIG. 5 is an equivalent circuit diagram of the pixel circuit for AC driving operating in a first stage provided in the embodiments of the present disclosure.

During a first stage t1, the equivalent circuit is as shown in FIG. 5, G(n) and CRT(n) are at a low level, EM(n) is at a low level. T1, T2, T3, T4 and T5 are turned on, meanwhile POWER2(*n*) jumps from VDD to VSS, POWER1(*n*) jumps from VSS to VDD. At this time, signal at the data line is VDD. DTFT1 is in a forward-biased state and DTFT2 is in a reverse-biased and turned-off state. This stage functions to remove the signal voltage of a previous stage, such that the potential at the point g is reset by a current through DTFT1, OLED1 is forward biased and a current flows through the OLED1, and the OLED2 is in an open state due to the turned-off DTFT2.

Figure 6:
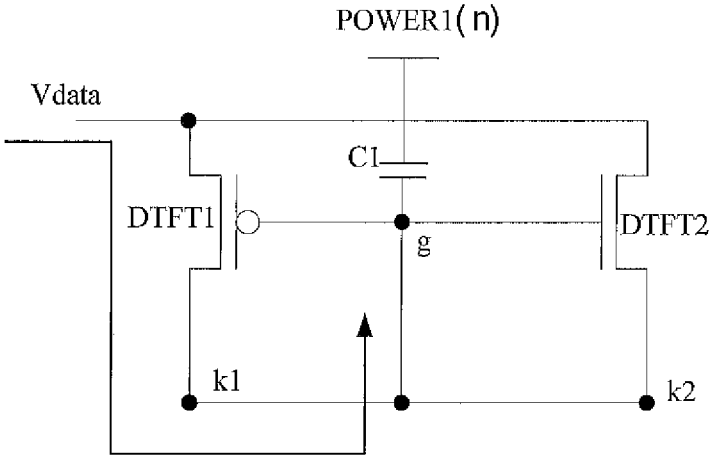
FIG. 6 is an equivalent circuit diagram of the pixel circuit for AC driving operating in a second stage provided in the embodiments of the present disclosure.

During a second stage t2, the equivalent circuit is as shown in FIG. 6, G(n) and CRT(n) are at the low level, EM(n) is at a high level. T1 and T4 are turned off, and T1, T3 and T5 are turned on. DTFT1 is forward biased and DTFT2 is in the reverse-biased and turned-off state. The voltage at the data line DATA jumps from VDD to a data voltage Vdata, and the capacitor C1 is charged by the data voltage Vdata through the DTFT1. Therefore, there is a current flowing through the DTFT1 to the gate of the DTFT1 until the potential at the point g becomes Vdata−|Vthd1|, wherein Vthd1 is a threshold voltage of the DTFT1. As a result, a voltage difference between two electrodes of C1 can be represented by: Vc=VDD−(Vdata−|Vthd1|).

It should be explained that there is no current flowing through the power supplies since the power supplies (the first voltage terminal POWER1(*n*) and the second voltage terminal POWER2(*n*)) are in an open state, and POWER1(*n*) is at the designed power supply voltage value VDD. That is, the voltage across the two electrodes of C1 is not affected by the internal resistance of the power supply line. At this time, OLED1 and OLED2 are both in an open state.

Figure 7:
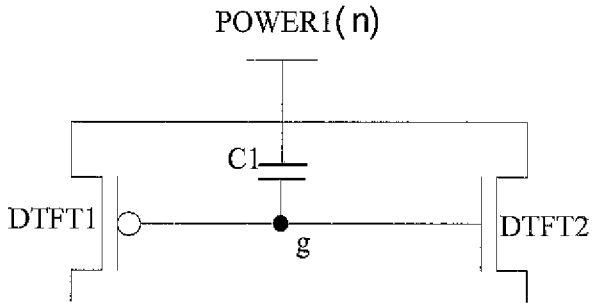
FIG. 7 is an equivalent circuit diagram of the pixel circuit for AC driving operating in a third stage provided in the embodiments of the present disclosure.

During a third stage t3, the equivalent circuit is as shown in FIG. 7, G(n) and CRT(n) jump to the high level and EM(n) is at the high level, such that T1, T2, T3, T4 and T5 are turned off, and DTFT1 and DTFT2 are in a turned-off state. This stage functions as an isolating stage, so as to avoid that G(n), CRT(n) and EM(n) jump at the same time to cause noise.

Figure 8A:
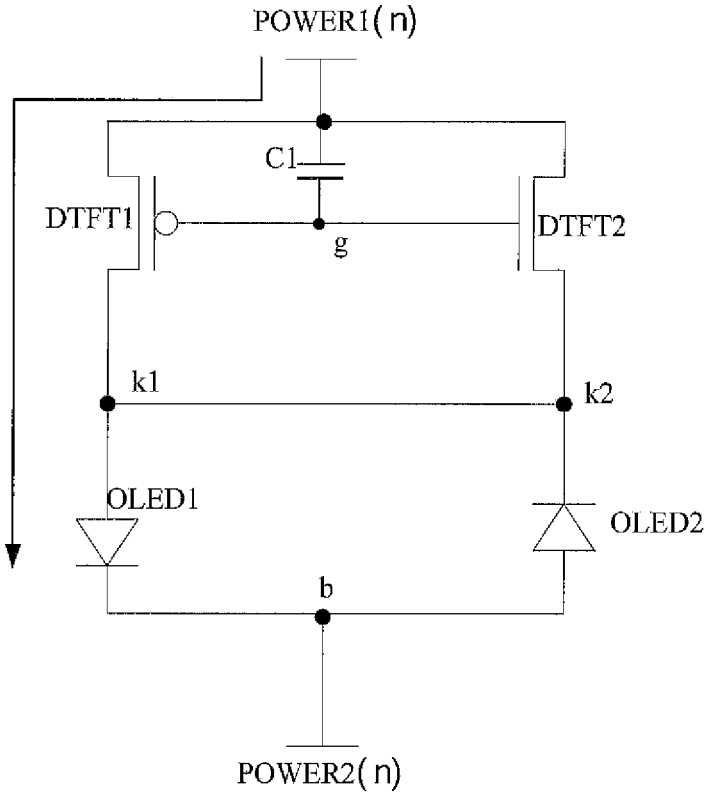
FIG. 8(*a*) is an equivalent circuit diagram of the pixel circuit for AC driving operating in a fourth stage provided in the embodiment of the present disclosure corresponding to FIG. 2.
Figure 8B:
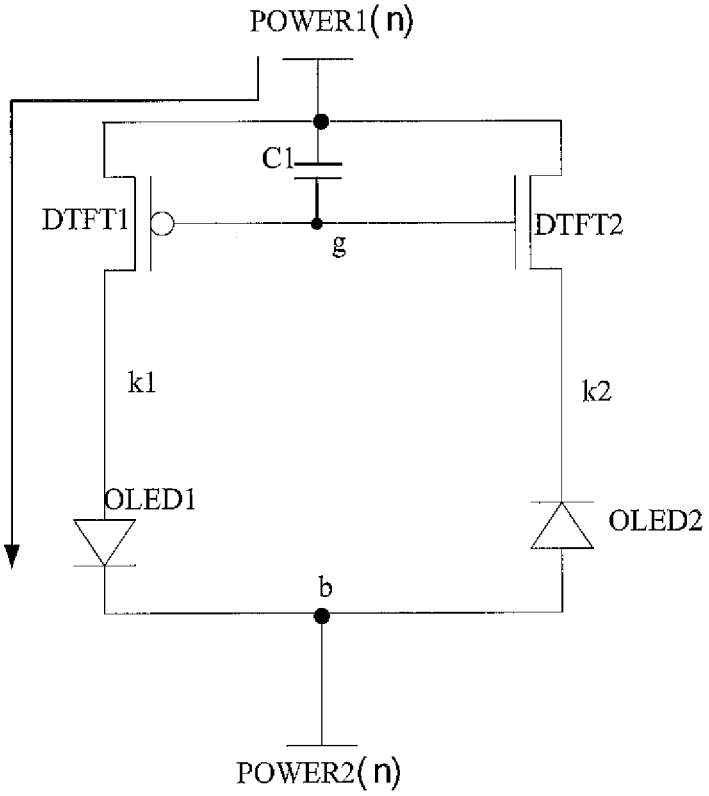

During a fourth stage t4, the equivalent circuit is as shown in FIG. 8(*a*) (corresponding to the pixel circuit shown in FIG. 2) and FIG. 8(*b*) (corresponding to the pixel circuit shown in FIG. 3(*a*)). Since the pixel circuit shown in FIG. 2 and the pixel circuit shown in FIG. 3(*a*) have different configuration, their equivalent circuits are different from each other slightly but can achieve the same function. In this stage, G(n) and CRT(n) are at the high level and EM(n) jumps to the low level, such that T1 and T4 are turned on and T2, T3 and T5 are turned off. The point g is floating since T3 and T5 are turned off. The gate-source voltage Vsg of the DTFT1 is the voltage Vc across the two electrodes of the capacitor C1 and can be represented by: Vsg=Vc=VDD−(Vdata−|Vthd1|).

The driving current flowing through the DTFT1 is the light-emitting current of the OLED1 and can be represented by:

$$\begin{aligned} Ioled1 &= Kd1(Vgs - |Vthd1|)\text{^}2 \\ &= Kd1(VDD - Vdata + |Vthd1| - |Vthd1|)\text{^}2 \\ &= Kd1(VDD - Vdata)\text{^}2 \end{aligned}$$

Kd1 is a constant relating to the manufacturing process and the driving configuration and is constant after the size of the DTFT1 and the manufacturing process are determined. Vthd1 is the threshold voltage of the DTFT1. The driving current is only affected by the data line voltage Vdata and VDD. However, as described for the second stage, the VDD is the designed voltage of the power supply which is determined when the data is written into the capacitor, and the internal resistance of the power supply line behind the power supply will not affect the voltage across the capacitor C1, thus the light-emitting current will not be affected by the internal resistance of the power supply line. OLED1 starts to be forward biased from this stage, enters the positive half cycle of the AC driving from the negative half cycle of the AC driving, and enters its operation phase. Meanwhile, OLED2 enters in a reverse-biased state from this stage, such that no current flows through the OLED2 and OLED does not emit light, and DTFT2 is in a turned-off state. OLED2 enters the negative half cycle of the AC driving from the positive half cycle of the AC driving and will stay in the negative half cycle of the AC driving during the time period of a frame. During the negative half cycle, the remaining holes and electrons change their moving directions to move toward opposite directions, which is equivalent to consuming the remaining holes and electrons, thus diminishing the built-in electrical field formed inside OLED2 by the remaining carriers in the positive half cycle, further enhancing the carrier injection and recombination of the next positive half cycle, and finally improving the recombination efficient. Moreover, the reverse bias process of the negative half cycle can "burn out" some microscopic small channels "filaments" turned on locally. Such a filament is actually caused by a kind of "pinhole" which is a fine hole formed due to non-uniform deposition during the semiconductor deposition process. The elimination of the pinholes is very important for extending the usage life of the device. Therefore, OLED2 is in a recovery period during the time period of this frame.

After the time period of one frame, the $n^{th}$ row enters into a $(N+1)^{th}$ frame, the operation of the circuit in the four stages for this frame is as follows.

Figure 9:
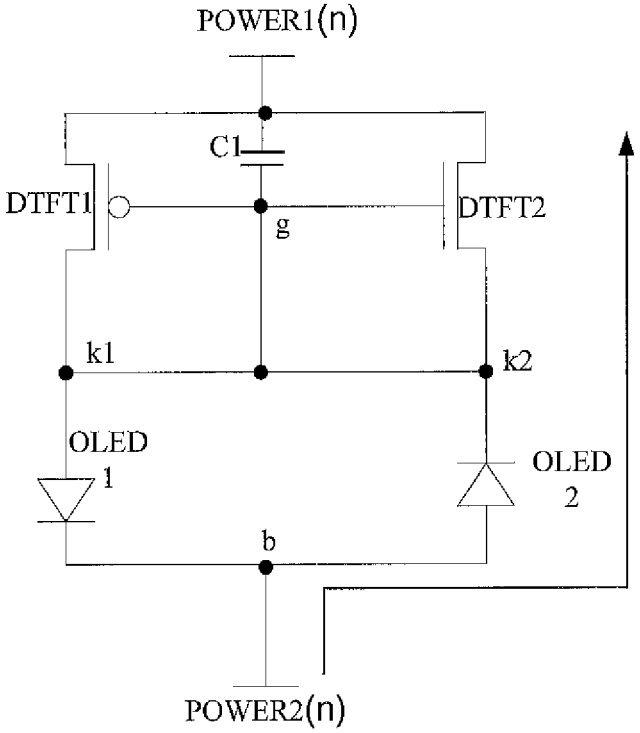
FIG. 9 is an equivalent circuit diagram of the pixel circuit for AC driving operating in a fifth stage provided in the embodiments of the present disclosure.

During a fifth stage t5, the equivalent circuit is as shown in FIG. 9, G(n) and CRT(n) are at the low level, EM(n) is at the low level. T1, T2, T3, T4 and T5 are turned on, meanwhile POWER2(*n*) jumps from VSS to VDD, POWER1(*n*) jumps from VDD to VSS. At this time, signal at the data line is the ON level of TFT VSS. DTFT1 is in a reverse-biased and turned-off state and DTFT2 is in a forward-biased state. This stage functions to remove the signal voltage of a previous stage, such that the potential at the point g is reset by a current through DTFT2, OLED2 is forward biased and a current flows through the OLED2, and OLED1 is in an open state due to the turned-off DTFT1.

Figure 10:
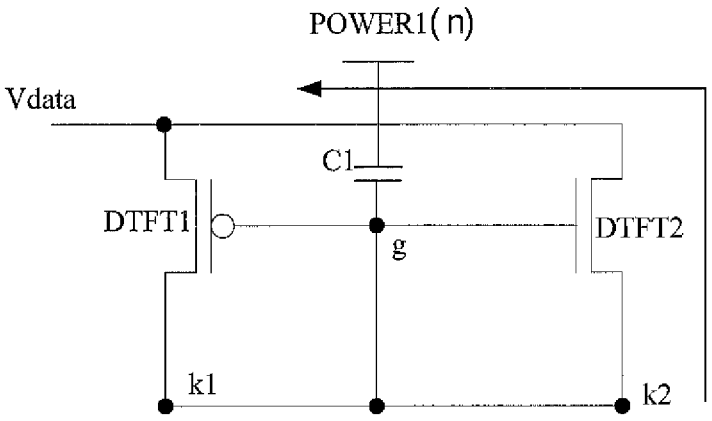
FIG. 10 is an equivalent circuit diagram of the pixel circuit for AC driving operating in a sixth stage provided in the embodiments of the present disclosure.

During a sixth stage t6, the equivalent circuit is as shown in FIG. 10, G(n) and CRT(n) are at the low level, EM(n) is at the high level. T1 and T4 are turned off, and T1, T3 and T5 are turned on. DTFT2 is forward biased and DTFT1 is in the reverse-biased and turned-off state. The voltage at the data line DATA jumps from VSS to the data voltage Vdata, and the capacitor C1 is discharged with respect to the data line through the DTFT2. Therefore, there is a current flowing through the DTFT2 to the source of the DTFT2 until the potential at the point g becomes Vdata+Vthd2, wherein Vthd2 is a threshold voltage of the DTFT2. As a result, a voltage difference between two electrodes of C1 can be represented by: Vc=Vdata+Vthd2−VSS.

It should be explained that there is no current flowing through the power supplies since the power supplies (the first voltage terminal POWER1(*n*) and the second voltage terminal POWER2(*n*)) are in the open state, and POWER1(*n*) is at the designed power supply voltage value VSS. That is, the voltage across the two electrodes of C1 is not affected by the internal resistance of the power supply line. At this time, OLED1 and OLED2 are both in the open state.

Figure 11:
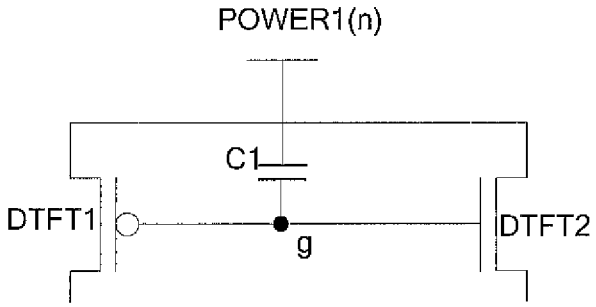
FIG. 11 is an equivalent circuit diagram of the pixel circuit for AC driving operating in a seventh stage provided in the embodiments of the present disclosure.

During a seventh stage t7, the equivalent circuit is as shown in FIG. 11, G(n) and CRT(n) jump to the high level and EM(n) is at the high level, such that T1, T2, T3, T4 and T5 are turned off, and DTFT1 and DTFT2 are in the turned-off state. This stage functions as an isolating stage, so as to avoid that G(n), CRT(n) and EM(n) jump at the same time to cause noise.

Figure 12A:
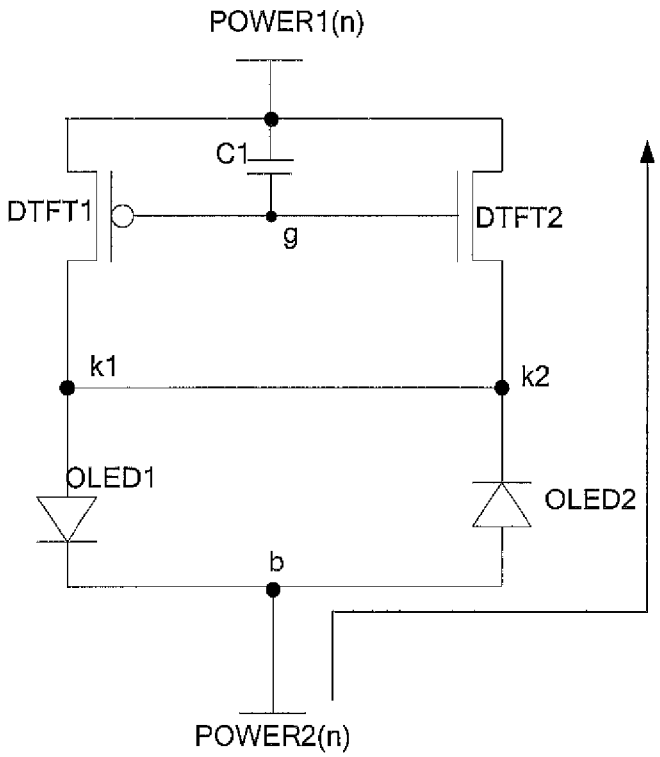
FIG. 12(*a*) is an equivalent circuit diagram of the pixel circuit for AC driving operating in an eighth stage provided in the embodiment of the present disclosure corresponding to FIG. 2.
Figure 12B:
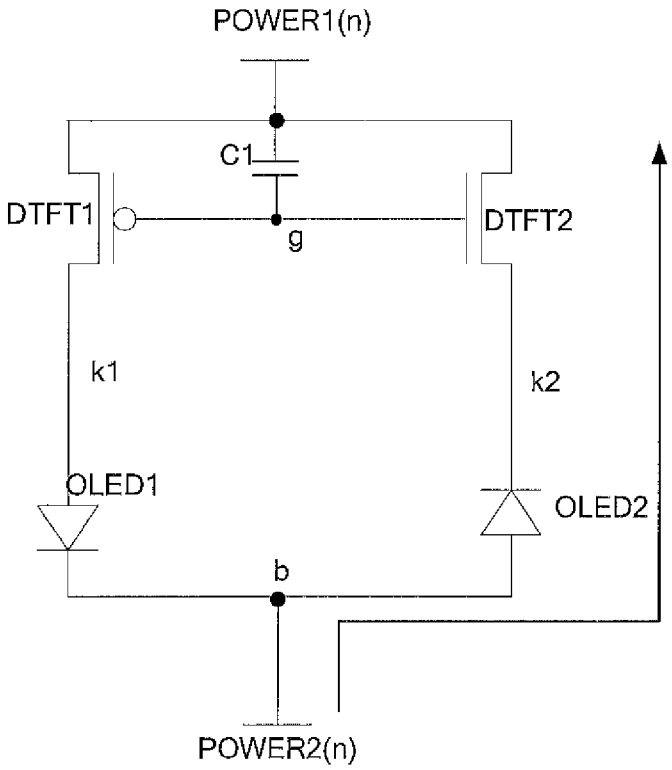

During an eighth stage t8, the equivalent circuit is as shown in FIG. 12(*a*) (corresponding to the pixel circuit shown in FIG. 2) and FIG. 12(*b*) (corresponding to the pixel circuit shown in FIG. 3(*a*)). Since the pixel circuit shown in FIG. 2 and the pixel circuit shown in FIG. 3(*a*) have different configuration, their equivalent circuits are different from each other slightly but can achieve the same function. In this stage, G(n) and CRT(n) are at the high level and EM(n)

jumps to the low level, such that T1 and T4 are turned on and T2, T3 and T5 are turned off. The point g is floating since T3 and T5 are turned off. The gate-source voltage Vgs of the DTFT2 is the voltage across the two electrodes of the capacitor C1 and can be represented by: Vgs=Vc=Vdata+Vthd2−VSS.

The driving current flowing through the DTFT2 is the light-emitting current of the OLED2 and can be represented by:

$$\begin{aligned} Ioled2 &= Kd2(Vgs - Vthd2)\text{^}2 \\ &= Kd2(Vdata + Vthd2 - VSS - Vthd2)\text{^}2 \\ &= Kd2(Vdata - VSS)\text{^}2 \end{aligned}$$

Kd2 is a constant relating to the manufacturing process and the driving configuration, and Vthd2 is the threshold voltage of the DTFT2. The driving current is only affected by the data line voltage Vdata and VSS. However, as described for the sixth stage, the VSS is the designed voltage of the power supply which is determined when the data is written into the capacitor, and the internal resistance of the power supply line behind the power supply will not affect the voltage across the capacitor C1, thus the light-emitting current will not be affected by the internal resistance of the power supply line. OLED2 starts to be forward biased from this stage, enters the positive half cycle of the AC driving from the negative half cycle of the AC driving, and enters its operation phase. Meanwhile, OLED1 enters in a reverse-biased state from this stage, enters the negative half cycle of the AC driving from the positive half cycle of the AC driving, and enters a recovery period. Same as the function of the circuit on OLED2 in the fourth stage, this stage can extend the usage life of OLED1.

The operation of the driving circuit during two adjacent frames according to the embodiments of the present disclosure has been described above. It should be explained that the data line should supply different data line voltages for different driving transistors since the driving transistors are different and the expressions of the driving current are also different during the two adjacent frames. Particularly, with reference to the timing sequence state diagram as shown in FIG. 4, the data line supplies VDD during the first stage, supplies the data signal Vdata during the second stage, supplies VDD during the third stage and supplies the data signal Vdata during the fourth stage during the $N^{th}$ frame; the data line supplies VSS during the fifth stage, supplies the data signal Vdata during the sixth stage, supplies VSS during the seventh stage and supplies the data signal Vdata during the eighth stage during the $N+1^{th}$ frame. Of course, optionally, with reference to FIG. 2, the corresponding function can also be achieved when 5 switching transistors are adopted in the embodiments of the present disclosure, and the operation principle is the same and repeated description is omitted herein. Of course, the switching transistors in the pixel circuit can adopt the thin film transistors produced under the process of amorphous silicon, polysilicon, oxide and so one, and the pixel circuit can be easily modified into other NMOS, PMOS or CMOS circuit after simplification, replacement or combination only if the timing sequence relationship of the input signals is adjusted correspondingly. Therefore, any variation or modification falls in the scope of the embodiments of the present disclosure only if it does not depart from the essential nature of the embodiments of the present disclosure. In addition, G(n) and CRT(n) in the above circuit may have a same timing sequence or have two opposite timing sequences according to the switching transistors to be controlled, and when G(n) and CRT(n) have a same timing sequence, these two scan signal terminals may be set at a same commonly used terminal, and complexity of wiring of the lines can be reduced when the scan signals are provided by the same scan line.

The above descriptions are only for illustrating the embodiments of the present disclosure, and in no way limit the scope of the present disclosure. It will be obvious that those skilled in the art may make variations or alternatives to the above embodiments without departing from the spirit and scope of the present disclosure as defined by the following claims. Such variations and alternatives are intended to be included within the spirit and scope of the present disclosure.

The present application claims the priority of a Chinese application entitled "pixel circuit for AC driving, driving method and display apparatus" with an application No. 201310529546.1 and filed on Oct. 31, 2013, the disclosure of which is entirely incorporated herein by reference.

What is claimed is:

1. A pixel circuit for AC driving comprising:

a capacitor, a first voltage input unit, a second voltage input unit, a data signal input unit, a first light emitting unit, a second light emitting unit and a light emitting control unit; wherein the first light emitting unit is configured to emit light under the control of a driving control terminal, a first light emitting control terminal, a first voltage input terminal and a second voltage input terminal;

the second light emitting unit is configured to emit light under the control of the driving control terminal, a second light emitting control terminal, the first voltage input terminal and the second voltage input terminal; wherein the first light emitting unit emits light during a preset first time period and the second light emitting unit emits light during a preset second time period;

the first voltage input unit is configured to supply a first input voltage at a first voltage terminal to the first light emitting unit and the second light emitting unit under the control of a first scan terminal;

the second voltage input unit is configured to supply a second input voltage at a second voltage terminal to the first light emitting unit and the second light emitting unit under the control of the first scan terminal;

the data signal input unit is configured to supply a data line signal to the first voltage input terminal through a data line under the control of a second scan terminal;

the light emitting control unit is configured to make the first light emitting unit or the second light emitting unit emit light by aid of the driving control terminal, the first light emitting control terminal and the second light emitting control terminal under the control of a third scan terminal;

a first electrode of the capacitor is connected to the first voltage terminal and a second electrode of the capacitor is connected to the driving control terminal.

2. The pixel circuit of claim 1, wherein the first light emitting unit comprises a first driving transistor and a first light emitting diode; wherein the first driving transistor has a gate connected to the driving control terminal, a source connected to the first voltage input terminal and a drain connected to the first light emitting control terminal;

the first light emitting diode has a first electrode connected to the first light emitting control terminal and a second electrode connected to the second voltage input terminal;

the second light emitting unit comprises a second driving transistor and a second light emitting diode, wherein the second driving transistor has a gate connected to the driving control terminal, a source connected to the first voltage input terminal and a drain connected to the second light emitting control terminal;

the second light emitting diode has a first electrode connected to the second voltage input terminal and a second electrode connected to the second light emitting control terminal;

the first driving transistor and the second driving transistor are of different types.

3. The pixel circuit of claim 1, wherein the light emitting control unit comprises a third switching transistor having a gate connected to the third scan terminal, a source connected to the driving control terminal, and a drain connected to the first light emitting control terminal and the second light emitting control terminal; or the light emitting control unit comprises a third switching transistor and a fifth switching transistor, the third switching transistor has a gate connected to the third scan terminal, a source connected to the driving control terminal and a drain connected to the first light emitting control terminal, and the fifth switching transistor has a gate connected to the third scan terminal, a source connected to the driving control terminal and a drain connected to the second light emitting control terminal.

4. The pixel circuit of claim 1, wherein the first voltage input unit comprises a first switching transistor having a gate connected to the first scan terminal, a source connected to the first voltage terminal, and a drain connected to the first voltage input terminal.

5. The pixel circuit of claim 1, wherein the data signal input unit comprises a second switching transistor having a gate connected to the second scan terminal, a source connected to the data line, and a drain connected to the first voltage input terminal.

6. The pixel circuit of claim 1, wherein the second voltage input unit comprises a fourth switching transistor having a gate connected to the first scan terminal, a source connected to the second voltage terminal, and a drain connected to the second voltage input terminal.

7. The pixel circuit of claim 1, wherein the first light emitting unit emits light during a preset high level period supplied at the first voltage terminal and during a preset low level period supplied at the second voltage terminal, and the second light emitting unit emits light during a preset low level period supplied at the first voltage terminal and during a preset high level period supplied at the second voltage terminal.

8. A display apparatus comprising a pixel circuit for AC driving, wherein the pixel circuit comprises: a capacitor, a first voltage input unit, a second voltage input unit, a data signal input unit, a first light emitting unit, a second light emitting unit and a light emitting control unit; wherein the first light emitting unit is configured to emit light under the control of a driving control terminal, a first light emitting control terminal, a first voltage input terminal and a second voltage input terminal;

the second light emitting unit is configured to emit light under the control of the driving control terminal, a second light emitting control terminal, the first voltage input terminal and the second voltage input terminal;

wherein the first light emitting unit emits light during a preset first time period and the second light emitting unit emits light during a preset second time period;

the first voltage input unit is configured to supply a first input voltage at a first voltage terminal to the first light emitting unit and the second light emitting unit under the control of a first scan terminal;

the second voltage input unit is configured to supply a second input voltage at a second voltage terminal to the first light emitting unit and the second light emitting unit under the control of the first scan terminal;

the data signal input unit is configured to supply a data line signal to the first voltage input terminal through a data line under the control of a second scan terminal;

the light emitting control unit is configured to make the first light emitting unit or the second light emitting unit emit light by aid of the driving control terminal, the first light emitting control terminal and the second light emitting control terminal under the control of a third scan terminal;

a first electrode of the capacitor is connected to the first voltage terminal and a second electrode of the capacitor is connected to the driving control terminal.

9. The display apparatus of claim 8, wherein the first light emitting unit comprises a first driving transistor and a first light emitting diode; wherein the first driving transistor has a gate connected to the driving control terminal, a source connected to the first voltage input terminal and a drain connected to the first light emitting control terminal;

the first light emitting diode has a first electrode connected to the first light emitting control terminal and a second electrode connected to the second voltage input terminal;

the second light emitting unit comprises a second driving transistor and a second light emitting diode, wherein the second driving transistor has a gate connected to the driving control terminal, a source connected to the first voltage input terminal and a drain connected to the second light emitting control terminal;

the second light emitting diode has a first electrode connected to the second voltage input terminal and a second electrode connected to the second light emitting control terminal;

the first driving transistor and the second driving transistor are of different types.

10. The display apparatus of claim 8, wherein the light emitting control unit comprises a third switching transistor having a gate connected to the third scan terminal, a source connected to the driving control terminal, and a drain connected to the first light emitting control terminal and the second light emitting control terminal; or the light emitting control unit comprises a third switching transistor and a fifth switching transistor, the third switching transistor has a gate connected to the third scan terminal, a source connected to the driving control terminal and a drain connected to the first light emitting control terminal, and the fifth switching transistor has a gate connected to the third scan terminal, a source connected to the driving control terminal and a drain connected to the second light emitting control terminal.

11. The display apparatus of claim 8, wherein the first voltage input unit comprises a first switching transistor having a gate connected to the first scan terminal, a source connected to the first voltage terminal, and a drain connected to the first voltage input terminal.

12. The display apparatus of claim 8, wherein the data signal input unit comprises a second switching transistor having a gate connected to the second scan terminal, a source connected to the data line, and a drain connected to the first voltage input terminal.

13. The display apparatus of claim 8, wherein the second voltage input unit comprises a fourth switching transistor having a gate connected to the first scan terminal, a source connected to the second voltage terminal, and a drain connected to the second voltage input terminal.

14. The display apparatus of claim 8, wherein the first light emitting unit emits light during a preset high level period supplied at the first voltage terminal and during a preset low level period supplied at the second voltage terminal, and the second light emitting unit emits light during a preset low level period supplied at the first voltage terminal and during a preset high level period supplied at the second voltage terminal.

15. A driving method of pixel circuit comprising:

during a first stage, controlling a first voltage input unit and a second voltage input unit to operate by aid of a first scan terminal such that a first voltage input terminal is connected to a first voltage terminal and a second voltage input terminal is connected to a second voltage terminal, controlling a data signal input unit to operate by aid of a second scan terminal and controlling a light emitting control unit to operate by aid of a third scan terminal such that voltage at a driving control terminal is reset;

during a second stage, controlling the first voltage input unit and the second voltage input unit to close by aid of the first scan terminal, controlling the data signal input unit to operate by aid of the second scan terminal and controlling the light emitting control unit to operate by aid of the third scan terminal such that a capacitor is charged by a data line;

during a third stage, controlling the first voltage input unit and the second voltage input unit to close by aid of the first scan terminal, controlling the data signal input unit to close by aid of the second scan terminal and controlling the light emitting control unit to operate by aid of the third scan terminal;

during a fourth stage, controlling the first voltage input unit and the second voltage input unit to operate by aid of the first scan terminal, controlling the data signal input unit to close by aid of the second scan terminal and controlling the light emitting control unit to close by aid of the third scan terminal such that a first light emitting unit is driven to emit light by aid of the driving control terminal, a first light emitting control terminal, the first voltage input terminal and the second voltage input terminal;

during a fifth stage, controlling the first voltage input unit and the second voltage input unit to operate by aid of the first scan terminal such that the first voltage input terminal is connected to the first voltage terminal and the second voltage input terminal is connected to the second voltage terminal, controlling the data signal input unit to operate by aid of the second scan terminal and controlling the light emitting control unit to operate by aid of the third scan terminal such that the voltage at the driving control terminal is reset;

during a sixth stage, controlling the first voltage input unit and the second voltage input unit to close by aid of the first scan terminal, controlling the data signal input unit to operate by aid of the second scan terminal and controlling the light emitting control unit to operate by aid of the third scan terminal such that the capacitor is charged by the data line;

during a seventh stage, controlling the first voltage input unit and the second voltage input unit to close by aid of the first scan terminal, controlling the data signal input unit to close by aid of the second scan terminal and controlling the light emitting control unit to operate by aid of the third scan terminal; and during an eighth stage, controlling the first voltage input unit and the second voltage input unit to operate by aid of the first scan terminal, controlling the data signal input unit to close by aid of the second scan terminal and controlling the light emitting control unit to close by aid of the third scan terminal such that a second light emitting unit is driven to emit light by aid of the driving control terminal, a second light emitting control terminal, the first voltage input terminal and the second voltage input terminal.

16. The driving method of claim 15, wherein during the first stage, a first switching transistor, a second switching transistor, a third switching transistor, a fourth switching transistor and a first driving transistor are turned on, and a second driving transistor is turned off;

during the second stage, the first switching transistor, the fourth switching transistor and the second driving transistor are turned off, and the second switching transistor, the third switching transistor and the first driving transistor are turned on;

during the third stage, the first switching transistor, the second switching transistor, the third switching transistor and the fourth switching transistor are turned off, and the first driving transistor and the second driving transistor are turned off;

during the fourth stage, the first switching transistor, the fourth switching transistor and the first driving transistor are turned on, and the second switching transistor, the third switching transistor and the second driving transistor are turned off;

during the fifth stage, the first switching transistor, the second switching transistor, the third switching transistor, the fourth switching transistor and the second driving transistor are turned on, and the first driving transistor is turned off;

during the sixth stage, the first switching transistor, the fourth switching transistor and the first driving transistor are turned off, and the second switching transistor, the third switching transistor and the second driving transistor are turned on;

during the seventh stage, the first switching transistor, the second switching transistor, the third switching transistor and the fourth switching transistor are turned off, and the first driving transistor and the second driving transistor are turned off; and during the eighth stage, the first switching transistor, the fourth switching transistor and the second driving transistor are turned on, and the second switching transistor, the third switching transistor and the first driving transistor are turned off.

17. The driving method of claim 16, further comprising:

during the first stage, turning on the fifth switching transistor;

during the second stage, turning on the fifth switching transistor;

during the third stage, turning off the fifth switching transistor;

during the fourth stage, turning off the fifth switching transistor;

during the fifth stage, turning on the fifth switching transistor;

during the sixth stage, turning on the fifth switching transistor;

during the seventh stage, turning off the fifth switching transistor; and during the eighth stage, turning off the fifth switching transistor.

* * * * *